US005438759A

United States Patent [19]

Dieringer

[11] Patent Number: 5,438,759

[45] Date of Patent: Aug. 8, 1995

[54] BUTTON REMOVAL DEVICE

[76] Inventor: Janice A. Dieringer, P.O. Box 501 N741 Rolling Dr., Campbellsport, Wis. 53010

[21] Appl. No.: 248,107

[22] Filed: May 24, 1994

[51] Int. Cl.[6] ..... B26B 13/02

[52] U.S. Cl. ..... 30/234; 30/253; 254/28

[58] Field of Search ..... 227/63; 254/28, 18; 7/166, 125; 30/232, 234, 253, DIG. 8

[56] References Cited

U.S. PATENT DOCUMENTS

| | | | |
|---|---|---|---|
| D. 163,465 | 5/1951 | Marano | 254/28 |
| D. 309,412 | 7/1990 | Ancona et al. | D8/48 |
| 4,026,520 | 5/1977 | Rothfuss et al. | 254/28 |
| 4,674,727 | 6/1987 | McAlister | 254/28 |
| 4,685,460 | 8/1987 | Thornton | 254/28 |
| 4,805,876 | 2/1989 | Blake et al. | 254/8 |
| 5,085,404 | 2/1992 | Thieleke et al. | 254/28 |

*Primary Examiner*—Richard K. Seidel
*Assistant Examiner*—Allan M. Schrock

[57] ABSTRACT

A button removal device including a straight torsion spring separating a pair of gripping members wherein the gripping members have a cooperative set of jaws affixed thereon. A first gripping member has a split pointed jaw which engages a singular jaw located upon a second gripping member. Buttons affixed to card stock by wire or string are removed by slipping the jaws between the string or wire and the button while closing the jaws using finger pressure and pulling away thereby cutting the wire or string. Buttons affixed using staples are likewise easily removed.

1 Claim, 4 Drawing Sheets

BUTTON REMOVAL DEVICE

BACKGROUND OF THE INVENTION

1. Field of the Invention

The present invention relates to staple removal devices and more particularly pertains to a staple removal device which may be employed to remove newly acquired buttons from card stock wherein a general attachment means comprises one or more staplelike members, a wire, or a string.

2. Description of the Prior Art

The use of staple removal devices is known in the prior art. More specifically, staple removal devices heretofore devised for the removal of staples and potentially utilized for removal of buttons from card stock are known to consist basically of familiar, expected and obvious structural configurations, notwithstanding the myriad of designs encompassed by the crowded prior art which have been developed for the fulfillment of countless objectives and requirements.

The present invention is directed to improving devices for button removal from card stock in a manner which is safe, secure, economical and aesthetically pleasing.

For example, U.S. Pat. No. 5,090,662 to Koo discloses a staple remover comprising a first end having a dual pair of staple removing jaws and a second end comprising nippers which may be employed to grasp a staple for forcible removal particularly when one end portion of a staple remains embedded within stapled materials. The Koo invention generally provides for a dual pair of staple removing jaws formed as extensions of body member flanges thereof and have the disadvantage of exhibiting excessive spacing for use in removal of buttons from card stock. The present invention employs three jaw members in adjoining disposition thereby presenting a minimal spacing thereof and furthermore providing an ability to engage the closely spaced staples, wires, or strings employed in affixing buttons to card stock having a result of cutting, straightening legs formed thereof and permitting removal of an attached button therefrom.

In U.S. Pat. No. 5,090,663 to Crutchfield et al. a staple remover is disclosed. The Crutchfield et al. invention comprises a unitary projecting head affixed to a gripping handle wherein the projecting head comprises a somewhat pointed portion for engaging, lifting, and removing a bound staple and a spring clip which retains a plurality of staples so removed. There is no provision in the Crutchfield et al. invention for pivoting jaws for cutting, removing, or otherwise straightening the legs of the small staples, wires, or strings employed in affixing buttons to card stock. The present invention employs three jaw members wherein one jaw is pivotally affixed to two opposing similar jaws for removal of buttons wherein the removal involves cutting of a fastening wire, or string and straightening of the small staplelike fastener employed or otherwise formed therein.

In U.S. Pat. No. Des. 281,662 to Augustin the ornamental design of a staple puller is described comprising a spring loaded pair of dual jaw members affixed at a common pivotal axis by a rivet member. A disadvantage of the Augustin invention is the jaw spacing which is suitable for conventional, larger staples but is incapable of unclasping the small sized staples employed in holding buttons to card stock. A further disadvantage lies in the absence of a cutting means for severing the wires or strings employed in other forms of button attachment. The present invention comprises a pair of jaw members engaging a third jaw member wherein the three laws engage a staple, wire, or string over a relatively short length thereof and thereby provides for cutting wires or strings and unclasping small staples employed in affixing buttons to card stock.

In U.S. Pat. No. Des. 309,412 to Ancona et al. the ornamental design of a staple remover is disclosed for enabling an operator to remove conventional staples from staple bound materials. A disadvantage in this prior art lies in a lack of a provision for removal of the small bodied staples employed in affixing buttons to card stock. The present invention enables removal of the small bodied staples employed for the purpose of affixing buttons to card stock. A further disadvantage in the Acona et al. invention lies in the lack of a provision for cutting wires or strings employed to affix buttons to card stock. The present invention comprises a plurality of cutting jaws which engage the wire or string member and provide severance thereof which enables the removal of buttons affixed thereby.

U.S. Pat. No. Des. 308,807 to Yu discloses the ornamental design of a staple remover. The disclosure teaches a plier style device having a pair of dual jaw members for the purpose of engaging and removing conventional staples. The disclosure makes no provision for engaging and removing small bodied staples, strings, or wires employed to affix buttons to card stock. The present invention comprises a series of three adjacently disposed jaws exhibiting relative motion therein and engaging a small bodied staple, cutting a string, or severing a wire thereby permitting removal of a button affixed thereby.

Therefore, it can be appreciated that there exists a continuing need for new and improved button removal device which can be employed to remove a button from card stock wherein the button is affixed thereon using a wirelike staple. In this regard, the present invention substantially fulfills this need.

As illustrated by the background art, efforts are continuously being made in an attempt to improve removers of staples and staplelike fasteners. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of staple removal devices relevant to button removal from card stock now present in the prior art, the present invention provides an improved button removal device construction wherein the same can be utilized for the removal of buttons affixed to card stock using staples, wires, or strings. As such, the general purpose of the present invention, which will be described subsequently in greater detail, is to provide a new and improved button removal device apparatus and method which has all the advantages of the prior art staple removal devices related to the removal of buttons from card stock and none of the disadvantages.

The invention is defined by the appended claims with the specific embodiment shown in the attached drawings. For the purpose of summarizing the invention, the invention may be incorporated into a straight torsion spring fastened to and furthermore separating a pair of flattened gripping portions wherein a first gripping portion has a pair of flattened elongated jaw members orthogonally disposed thereupon and a second gripping portion has a single elongated jaw member orthogonally disposed thereupon, and furthermore the jaw members disposed upon the first and second gripping portions are maintained in opposition and separated from each other by the action of the straight torsion spring. The force of the straight torsion spring is overcome by manual pressure in use thereby permitting the opposing jaw members to approach each other and grasp a wire, staple, or string disposed therebetween. Further manual pressure provides a shearing action which, in combination with a tensile force applied thereupon severs the wire or string and straightens the legs of a staple member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved button removal device enabling the wire, string, or staple fastener affixing a button to card stock to be severed or otherwise disengaged thereby releasing the button held thereon.

It is therefore an additional object of the present invention to provide a new and improved button removal device which has all the advantages of the prior art staple remover devices employable for removing buttons from card stock and none of the disadvantages.

It is another object of the present invention to provide a new and improved button removal device which may be easily and efficiently manufactured and marketed.

It is a further object of the present invention to provide a new and improved button removal device which is of a durable and reliable construction.

An even further object of the present invention is to provide a new and improved button removal device which is susceptible of a low cost of manufacture with regard to both materials and labor, and which accordingly is then susceptible of low prices of sale to the consuming public, thereby making such button removal devices economically available to the buying public.

Still yet another object of the present invention is to provide a new and improved button removal device which provides in the apparatuses and methods of the prior art some of the advantages thereof, while simultaneously overcoming some of the disadvantages normally associated therewith.

Still another object of the present invention is to provide a new and improved button removal device capable of cutting steel and other wirelike materials employed in fastening buttons upon card stock.

Yet another object of the present invention is to provide a new and improved button removal device capable of engaging wire, string, or staple materials threadedly applied through the various hole perforating a button affixed to card stock and furthermore such engagement predisposes severance or other release of the affixing means.

Even still another object of the present invention is to provide a new and improved button removal device susceptible of singlehanded use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
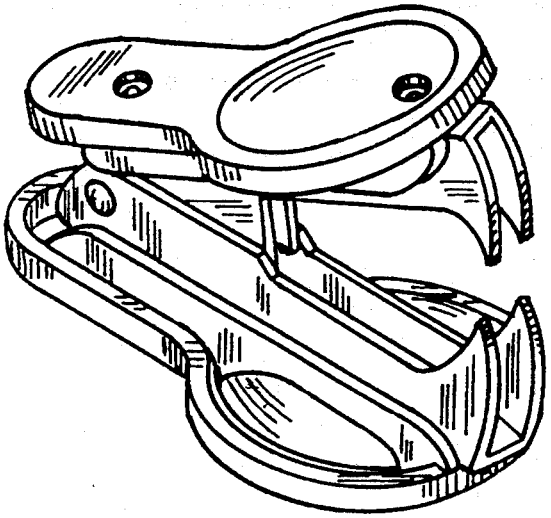
FIG 1 PRIOR ART
FIG. 1 is prior art.
Figure 2:
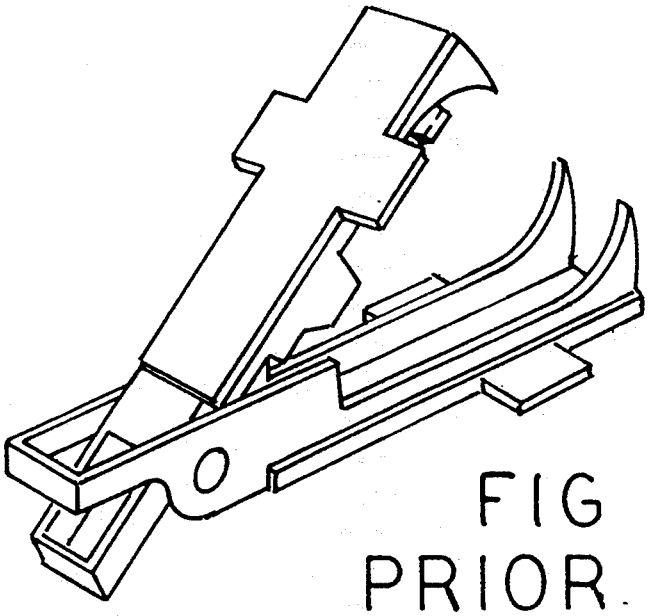
FIG 2 PRIOR ART
FIG. 2 is prior art.
Figure 3:
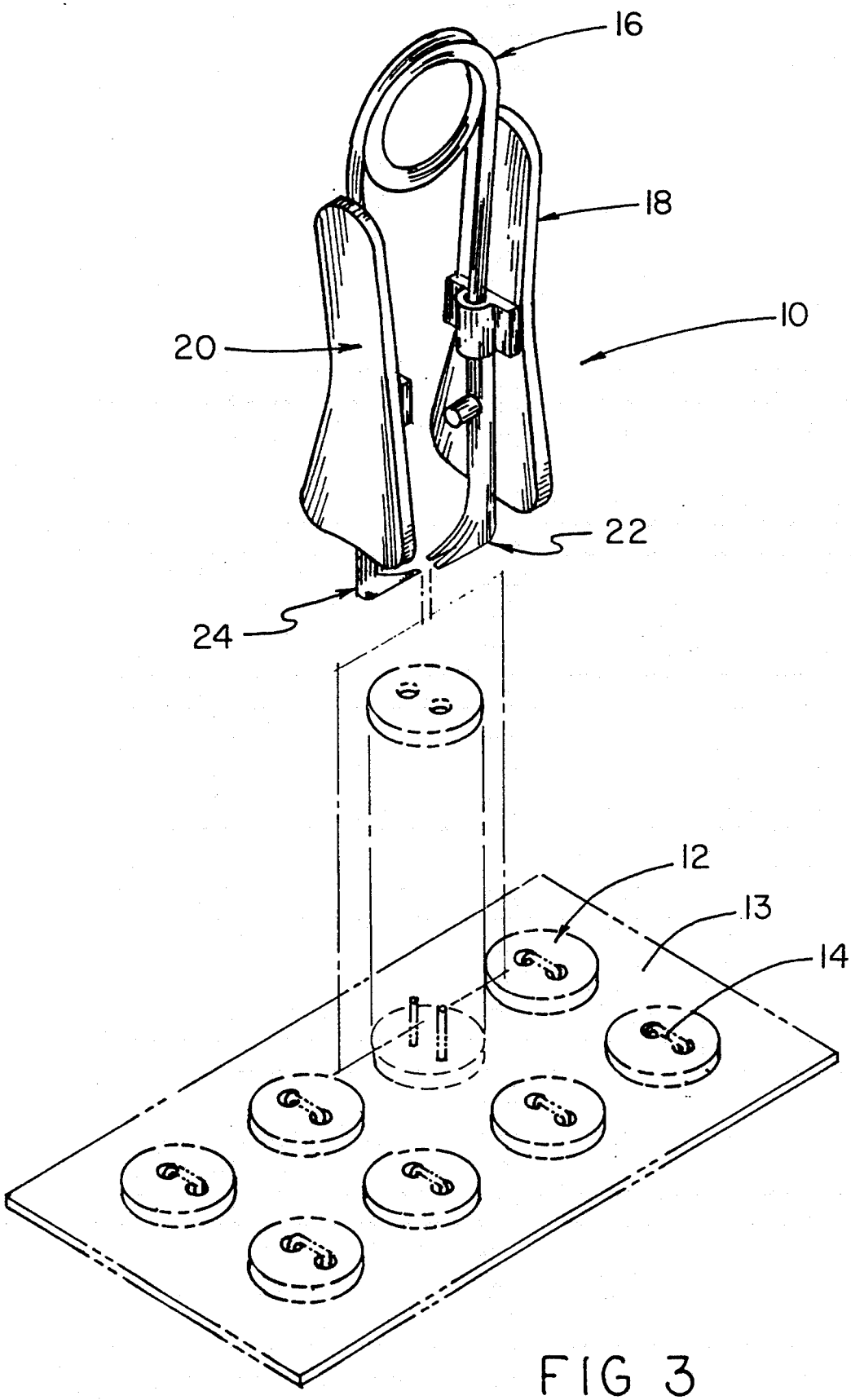
FIG. 3 is perspective view of the button removal device showing an operational disposition.

With reference now to the drawings, and in particular to FIG. 3 thereof, a new and improved button removal device embodying the principles and concepts of the present invention and generally designated by the reference numeral 10 will be described.

From an overview standpoint, the button removal device 10 is adapted for use with buttons 12 fastened to card stock 13 by wire, string, or staple fastening means 14 for the purpose of releasing the buttons 12 therefrom for impending use. See FIG. 3. Button removal device 10 comprises a straight torsion spring 16 affixed at one end to a first gripping member 18 and at another end to a second gripping member 20. First jaw member 22 is affixed to first gripping member 18 and second jaw member 24 is affixed to second gripping member 20 wherein the first jaw member and second jaw member may be caused to engage a button fastening means 14 by applying squeezing force to the first and second gripping members 18 and 20. Continued application of squeezing force and application of an additional pulling force directed away from the card stock will sever or otherwise release fastening means 14 thereby releasing button 12.

Figure 4:
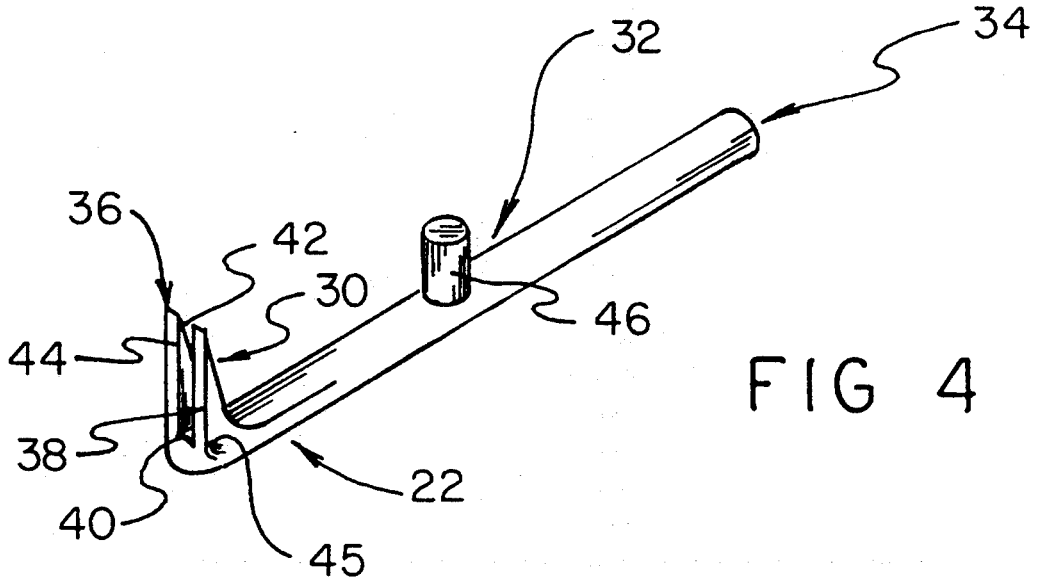
FIG. 4 is a perspective view of the button removal device showing a jaw member pair.

More specifically, it will be noted that the button removal device 10 comprises a straight torsion spring 16 permanently affixed to a first gripping member 18 and a second gripping member 20 having a first jaw member 22 and second jaw member 24 there attached. First jaw member 22 comprises an elongated metallic structure having a first end portion 30, a central portion 32, and a second end portion 34. See FIG. 4. First jaw member 22 is preferably of steel construction and generally at least a first end portion 30 may be hardened by heat treatment or other means to permit repetitive cutting of small diameter metal wires without damage.

First end portion 30 comprises a portion bifurcatingly formed into an L-shaped jaw portion 36 wherein the L-shaped jaw portion 36 is substantially orthogonally disposed with respect to central portion 32 and furthermore L-shaped jaw portion 36 is substantially orthogonally disposed with respect to gripping member 18. L-shaped jaw member 36 comprises a U-shaped portion having flattened legs 38 and a relatively small interleg spacing 40, and furthermore L-shaped jaw member 36 is smoothly enthickened from free pointed ends 44 to a transition line 45 wherein the L-shaped jaw portion 36 acquires the form of the central portion 32. Region 40 between legs 38 is necessarily uniform and may be formed therein by producing a narrow sawn slot in a solid member.

Edge 42 is preferably a hardened region and comprises a principal region for engaging to severance a button fastening means 14. First engagement of a button fastening means 14 is performed by points 44 there generally being two points 44 or otherwise sharp edges formed by grinding or shearing treatment of the free ends of legs 38. Central portion 32 comprises a substantially round wirelike elongated solid having a solid cylindrical stub 46 disposed substantially at a central position thereof and furthermore an axis of stub 46 is substantially aligned with legs 38. Stub 46 operationally performs a function of a stop which limits the engagement of the first and second jaw members 22 and 24 thereby preventing mechanical damage for excessive engagement thereof. Second end portion 34 comprises a cylindrical portion terminating in a planar end surface.

Figure 5:
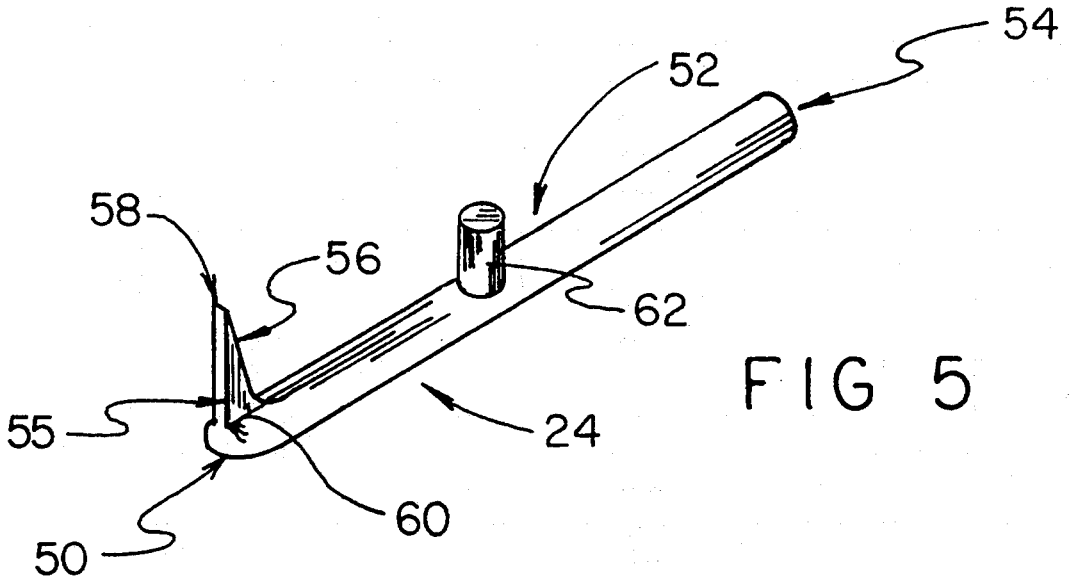
FIG. 5 is a perspective view of a button removal device showing a singular jaw member.

Second jaw member comprises a first end portion 50, a central portion 52, and a second end portion 54. See FIG. 5. First end portion 50 comprises a singular L-shaped jaw member 55 preferably having a hardened region 56 disposed along a substantially curving edge thereof wherein the hardened region 56 comprises a principal region for engaging to severance a button fastening means 14. L-shaped jaw member 55 is smoothly enthickened from a free pointed end 58 to a transition line 60 wherein the L-shaped jaw member 55 acquires the form of the central portion 52.

In use, first end portion 50 slidably engages legs 38 and cooperatively lifts button fastening means 14 by displacement toward thickening portions of L-shaped jaw member 55 and L-shaped jaw member 36. Central portion 52 comprises a substantially round wirelike elongated solid having a solid cylindrical stub 62 disposed substantially at a central position thereof and furthermore an axis of stub 62 is substantially aligned with L-shaped jaw member 55. Stub 62 operationally performs a function of a stop which limits the engagement of the first and second jaw members 22 and 24 thereby preventing mechanical damage for excessive engagement thereof. Second end portion 54 comprises a cylindrical portion terminating in a planar end surface.

Figure 6:
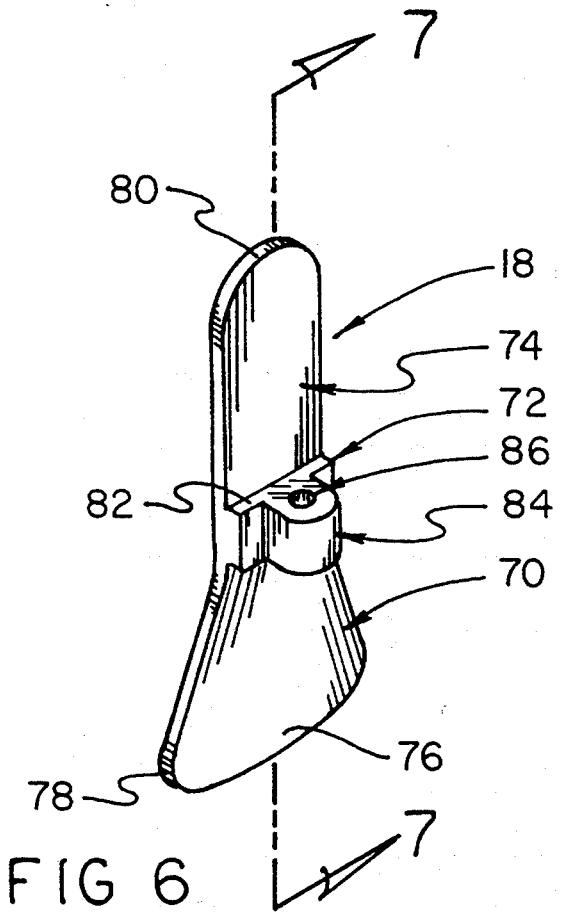
FIG. 6 is a perspective view the button removal device showing a gripping member.
Figure 7:
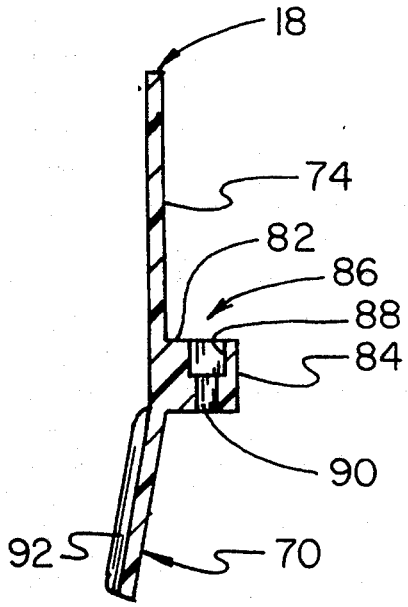
FIG. 7 is a side sectional view of the button removal device taken substantially upon the plane indicated by the section line 7—7 of FIG. 6 showing a gripping member.

Gripping member 18 and 22 comprises a substantially flattened paddle having a first end portion 70, a central portion 72, and a second end portion 74. See FIGS. 6 and 7. Gripping members 18 and 20 are generally of polymeric composition throughout. Gripping member 18 is substantially identical in shape and composition to gripping member 20. First end portion 70 comprises a planar portion having a widened free end 76 with curved corner treatments 78 thereof. A plane containing first end portion 70 is disposed at a slight angle to a plane common to the central portion 72 and the second end portion 74. Second end portion 74 comprises a planar portion of uniform width and terminates in a free end 80 having curved corners or a semicircular end treatment.

Central portion 72 comprises a ledge portion 82 having a protrusion 84 extending therefrom. Protrusion 84 is perforated by a stepped hole 86 having an enlarged diameter hole portion 88 disposed facing free end 80 of second end portion 74 and a reduced diameter hole portion 90 disposed facing free end 76 of first end portion 70. Enlarged diameter hole portion 88 engages an end of straight torsion spring 16 wherein the end is permanently affixed therein using a fastening means such as epoxy bonding, a press fit, or a mold in place technique. Reduced diameter hole portion 90 engages the second end portion 34 or 54 of first jaw member 22 or second jaw member 24 wherein the respective end portion is permanently affixed therein using a fastening means such as epoxy bonding, a press fit, or a mold in place technique. Pad 92 adhesively disposed upon a surface of first end portion 70 may be employed for added comfort in squeezing and enhanced frictional engagement thereof.

Figure 8:
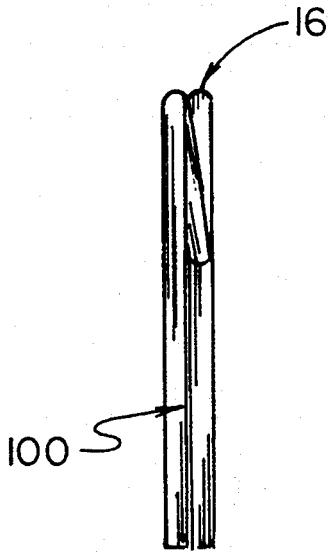
FIG. 8 is a side elevational view of a button removal device showing a straight torsion spring member.
Figure 9:
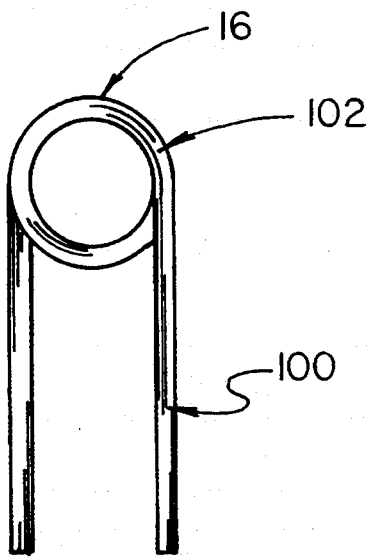
FIG. 9 is a side elevational view of a button removal device showing a straight torsion spring member.

Straight torsion spring 16 comprises a one and one half turn spring having each free end 100 emerging from a wound section 102 in a substantially parallel disposition, and furthermore free ends 100 are caused to either lie in a common plane by forming bends therein or are freely emergent in substantially adjacent planes wherein correction for a resulting lateral misalignment is generated by altering gripping members 18 and 20 to provide for misalignment of enlarged hole portion 88 in a given gripping member 18 and 20 pair. See FIGS. 8 and 9. Straight torsion spring 16 is of polymeric, spring steel, music wire, bronze alloy, or nickel steel construction.

In an alternate embodiment, first jaw member 22 and second jaw member 24 are detachably affixed to gripping member 18 and 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A button removal device for manual removal of buttons from card stock, comprising:

a straight torsion spring, said straight torsion spring being of steel, bronze, nickel-steel or polymeric composition and further being formed as a one and one half turn wound spring having substantially parallel elongated free ends;

a gripping member pair wherein each gripping member is affixed to an extended free end of said straight torsion spring, said gripping member comprising a first end portion comprising a thin plate having a widened free end with curving corners thereof, a central portion comprising a spring affixing means and a jaw affixing means and a second end portion comprising a thin plate having a uniform width throughout and curved corners thereon, said spring affixing means and said jaw affixing means comprising a thick raised portion having a hole of enlarged diameter bored partially therethrough and a hole of reduced diameter bored partially therethrough and in opposition to said hole of enlarged diameter, and furthermore said hole of enlarged diameter engages one of said free ends of the straight torsional spring; and a first jaw member and a second jaw member wherein each jaw member is affixed in one of said holes of reduced diameter by a fastening means and furthermore each of said first jaw member and said second jaw member has at least one substantially pointed free end thereof and has an incising portion distributed upon a plurality of edges therein.

* * * * *